US011505869B2

(12) United States Patent
Song et al.

(10) Patent No.: US 11,505,869 B2
(45) Date of Patent: Nov. 22, 2022

(54) OFFSHORE TENSION ANODE SYSTEM AND INSTALLATION METHOD THEREOF

(71) Applicant: DALIAN KINGMILE ANTICORROSION TECHNOLOGY CO., LTD., Liaoning (CN)

(72) Inventors: Shide Song, Liaoning (CN); Lei Liu, Liaoning (CN)

(73) Assignee: DALIAN KINGMILE ANTICORROSION TECHNOLOGY CO., LTD., Liaoning (CN)

( * ) Notice: Subject to any disclaimer, the term of this patent is extended or adjusted under 35 U.S.C. 154(b) by 306 days.

(21) Appl. No.: 16/755,508

(22) PCT Filed: Feb. 4, 2018

(86) PCT No.: PCT/CN2018/075192
§ 371 (c)(1),
(2) Date: Apr. 10, 2020

(87) PCT Pub. No.: WO2019/071884
PCT Pub. Date: Apr. 18, 2019

(65) Prior Publication Data

US 2021/0180195 A1 Jun. 17, 2021

(30) Foreign Application Priority Data

Oct. 13, 2017 (CN) ..... 201710951168.4

(51) Int. Cl.
*C23F 13/18* (2006.01)
*E02B 17/02* (2006.01)
*E02B 17/00* (2006.01)

(52) U.S. Cl.
CPC ..... *C23F 13/18* (2013.01); *E02B 17/027* (2013.01); *C23F 2213/31* (2013.01); *E02B 2017/0069* (2013.01)

(58) Field of Classification Search
CPC ..... C23F 13/18; C23F 2213/31; C23F 13/06; E02B 17/0026; E02B 2017/0069; E02B 17/027
See application file for complete search history.

(56) References Cited

U.S. PATENT DOCUMENTS 4,056,446 A * 11/1977 Vennett ..... C23F 13/04 205/730
4,226,555 A * 10/1980 Bourne, Jr. ..... B63B 21/502 114/264

(Continued)

FOREIGN PATENT DOCUMENTS

CN 201722427 U 1/2011
CN 103060816 A 4/2013

(Continued)

*Primary Examiner* — Carib A Oquendo
(74) *Attorney, Agent, or Firm* — Novick, Kim & Lee, PLLC; Allen Xue

(57) ABSTRACT

The invention discloses an offshore Tension Anode system and an installation method thereof. The system comprises a tension platform, a tension device, a composite cable integrated with auxiliary anodes and reference electrodes, and a gravity type foundation base, wherein the tension device is installed on the tension platform; the upper end of the composite cable is tensioned by the tension device, and the lower end of the composite cable sinks to a seabed along with the gravity type foundation base and is anchored by the gravity type foundation base; and the composite cable integrated with the auxiliary anodes and the reference electrodes is a main part of the system. The system is simple in structure and convenient to install and transport. The invention further discloses the installation method of the system, which can safely and reliably install the offshore tension anode system on an offshore platform. The installation method mainly comprises: (1) lifting the composite cable and the gravity type foundation base to an offshore platform;

(Continued)

(2) installing the gravity type foundation base on a seabed; (3) installing the composite cable; (4) tension adjustment and lock fixation of composite cable.

7 Claims, 4 Drawing Sheets

(56) References Cited

U.S. PATENT DOCUMENTS

| | | | | | |
|---|---|---|---|---|---|
| 4,619,557 | A | * | 10/1986 | Salama | E02B 17/0026 204/196.18 |
| 4,690,587 | A | * | 9/1987 | Petter | C23F 13/04 204/196.07 |
| 4,941,775 | A | * | 7/1990 | Benedict | E02B 17/0004 405/195.1 |

FOREIGN PATENT DOCUMENTS

| | | | | | |
|---|---|---|---|---|---|
| CN | 203096180 | U | | 7/2013 | |
| CN | 204298462 | U | | 4/2015 | |
| CN | 205473997 | U | | 8/2016 | |
| CN | 107326367 | A | | 11/2017 | |
| CN | 107541732 | A | | 1/2018 | |
| WO | WO-2015052450 | A1 | * | 4/2015 | E02B 17/027 |

* cited by examiner

OFFSHORE TENSION ANODE SYSTEM AND INSTALLATION METHOD THEREOF

TECHNICAL FIELD

The invention belongs to the technical field of offshore platform engineering equipment and particularly relates to an offshore tension anode system and an installation method thereof.

DESCRIPTION OF RELATED ART

Impressed current cathodic protection systems of tension anodes are applied to the field of corrosion prevention of undersea structures. Wherein, auxiliary anodes and reference electrodes are integrated on composite cables, which are placed close to pre-determined underwater structures to be protected and are tensioned by a tensioning system on a platform and a gravity type foundation base arranged on the seabed. The whole process from lifting the composite cables from a ship to sinking the composite cables for an intended-position installation is extremely complicated and the high connection and cooperation requirements of all links may cause difficulties in control and installation failures. Thus, it is particularly important to develop a safe and reliable tension system and an installation method thereof.

BRIEF SUMMARY OF THE INVENTION

To solve the above-mentioned problems, the invention provides an offshore tension anode system which is simple in structure, convenient to operate and convenient to lift and assemble, and also provides an installation method of the offshore tension anode system.

The technical means adopted by the invention is as follows:

An offshore tension anode system, comprising a tension platform, a tension device, a composite cable, and a gravity type foundation base, wherein the composite cable is integrated with auxiliary anodes and reference electrodes, the tension device is installed on the tension platform, and an end of the composite cable is connected to the tension platform through the tension device and the other end of the composite cable is sinking to a seabed by connecting with the gravity type foundation base; and the gravity type foundation base includes an upper block and a lower block, wherein the upper block and the lower block are two separate structures, a main lifting lug is arranged on the lower block, a main central hole is arranged in a center of the upper block, the upper block is penetrated through by the main lifting lug via the central hole and is placed above the lower block, and auxiliary lifting lugs are arranged on an upper surface of the upper block.

Furthermore, the tension device includes a tension rod device and a locking device, wherein the tension rod device includes a tensioning jack and has an end connected to the composite cable and the other end used for tensioning the composite cable by means of the tensioning jack, and the locking device is used to fixedly lock the composite cable which has been tensioned by the tension rod device on the tension platform.

Furthermore, the upper block includes an upper plate I, a lower plate I, an external annular side wall I, an internal annular side wall I, and a group of balancing weights I, wherein the upper plate I, the lower plate I, the external annular side wall I, and the internal annular side wall I are welded to form an annular cavity I, and the balancing weights I are arranged in the annular cavity I, and the auxiliary lifting lug is arranged on the upper plate I; and the lower block includes an upper plate II, a lower plate II, an external annular side wall II, an annular apron plate, a conical cavity plate, a filler, a group of balancing weights II, and the main lifting lug. wherein the upper plate II, the lower plate II, and the external annular side wall II are welded to form a cavity II, the balancing weights II are arranged in the cavity II, the conical cavity plate is welded to a lower surface of the lower plate II to form a conical cavity together with the lower plate II, the filler is injected into the conical cavity, and the annular apron plate is welded to an edge of the lower plate II; and the lower block is further provided with an ROV (Remote Operated Vehicle) operating handle.

An installation method of an offshore tension anode system, comprising the following steps: (1) lifting a composite cable and a gravity type foundation base to an installation platform: respectively lifting a cable reel spiraled with the composite cable which is integrated with auxiliary anodes and reference electrodes and the gravity type foundation base to the installation platform by a crane; (2) installing the gravity type foundation base on a seabed: connecting a wire rope of a winch to a main lifting lug of a lower block, sinking the lower block to an intended position area defined by sandbags on the seabed, and then retrieving the wire rope; and connecting the wire rope to auxiliary lifting lugs of an upper block, sinking the upper block to let the main lifting lug of the lower block penetrate through a central hole of the upper block, to complete assembling of the upper block and the lower block, and then retrieving the wire rope; (3) installing the composite cable: connecting one end of the composite cable spiraled on the cable reel to a heavy ball and the wire rope of the winch, and starting the cable reel to rotate to release the composite cable, wherein with the descending of the heavy ball and the dragging of the wire rope of the winch, the composite cable is sunk close to the gravity type foundation base; and connecting the composite cable to the gravity type foundation base by an ROV; and (4) tension adjustment and lock fixation of composite cable: connecting the other end of the composite cable to a tension rod device of a tension device on a tension platform; tensioning the composite cable by the tension rod device to adjust tension of the composite cable in water; and fixedly locking the composite cable with adjusted tension on the tension platform, by the locking device of the tension device.

Furthermore, in Step (1), the process of lifting the gravity type foundation base to the installation platform by the lifting machines is as follows: an upper plate I, a lower plate I, an external annular side wall I, an internal annular side wall I and a group of balancing weights I which constitute the upper block, and an upper plate II, a lower plate II, an external annular side wall II, an annular apron plate, a conical cavity plate, a filler, a group of balancing weight II, an ROV operating handle and the main lifting lug which constitute the lower block are respectively lifted to the installation platform by the lifting machines, and the parts of the upper block are welded and assembled to form the upper block and the parts of the lower block are welded and assembled to form the lower block on the installation platform.

Furthermore, in Step (2), the gravity type foundation base is accurately positioned by a sonar system when sinking to the seabed and an assembly process of the upper block and the lower block is detected by the ROV.

Furthermore, in Step (3), an installation process of the composite cable is further as follows: the composite cable is tracked, detected and positioned in real time by the ROV when sinking close to the gravity type foundation base and after being sinking close to the gravity type foundation base, the composite cable is separated from the heavy ball and is then connected to the gravity type foundation base by the ROV.

Compared with the prior art, the offshore tension anode system of the invention has the following beneficial effects: 1, the gravity type foundation base of this system has a separable structure and the weight of each gravity type foundation base portion is reduced, so that the system is convenient to lift and install; and the lifting machines with a small lifting capacity can be adopted, so that the installation cost is reduced; 2, the gravity type foundation base is formed by modular assemblies which can be conveniently welded and assembled on the installation platform on site; 3 the installation method of the offshore tension anode system has the advantages of clear steps, safety, reliability, convenience and rapidity; 4, the gravity type foundation base and the composite cable are monitored and detected in real time by the ROV in the installation process of the offshore tension anode system, so that the positioning accuracy is ensured; and the composite cable is unhooked and is then connected to the gravity type foundation base by the ROV, so that the method is simple and easy to operate and has high connection strength.

In the figures: 1, offshore platform; 2, composite cable; 3, tension device; 4, gravity type foundation base; 5, sandbag; 6, floating marker ball; 7, cable reel; 21, auxiliary anode; 22, reference electrode; 31, tension rod device; 32, locking device; 41, upper block; 42, lower block; 43, central hole; 44, main lifting lug; 45, auxiliary lifting lug; 411, upper plate I; 412, lower plate I; 413, external annular side wall I; 414, internal annular side wall I; 415, balancing weight I; 421, upper plate II; 422, lower plate II; 423, external annular side wall II; 424, annular apron plate; 425, conical cavity plate; 426, filler; 427, balancing weight II; 428, ROV operating handle.

DETAILED DESCRIPTION OF THE INVENTION

Figure 1:
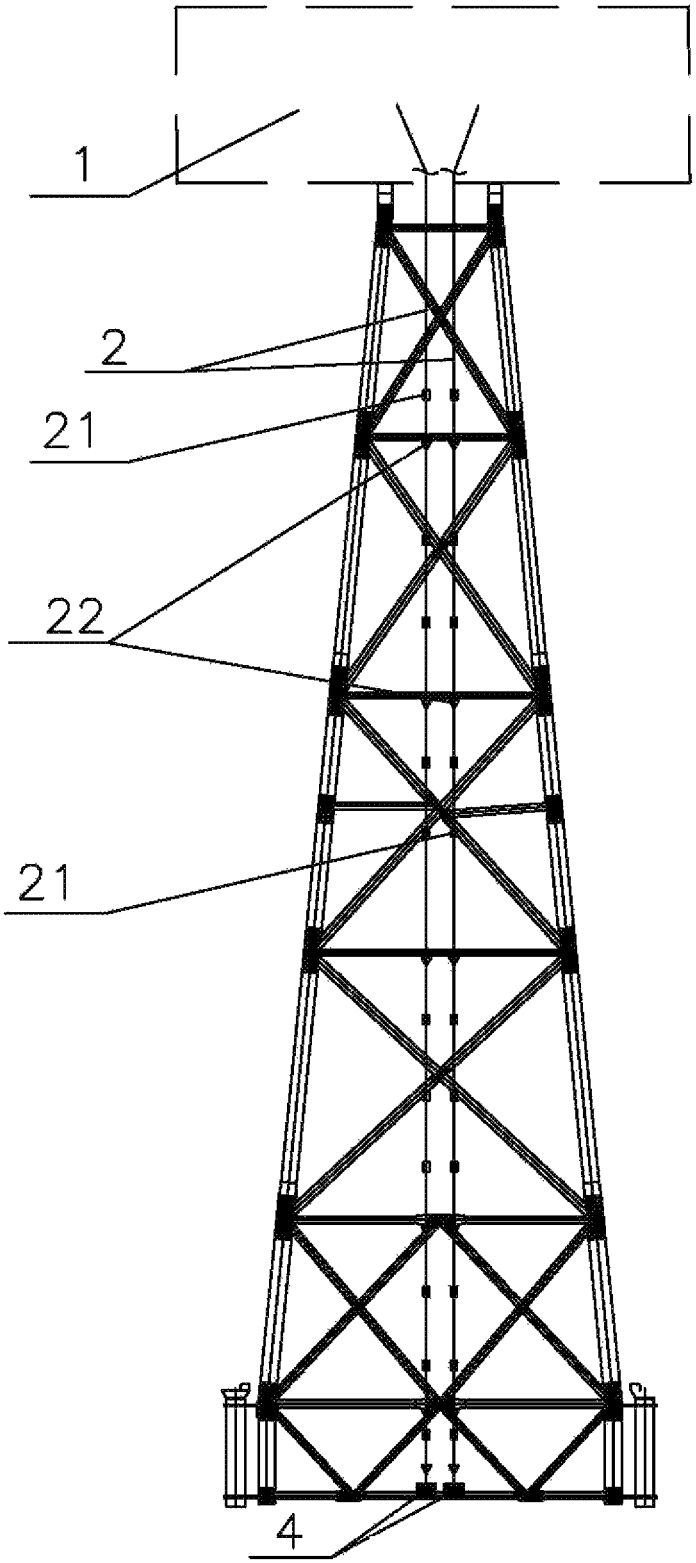
FIG. 1 is a structural diagram of an offshore tension anode system of the invention.
Figure 2:
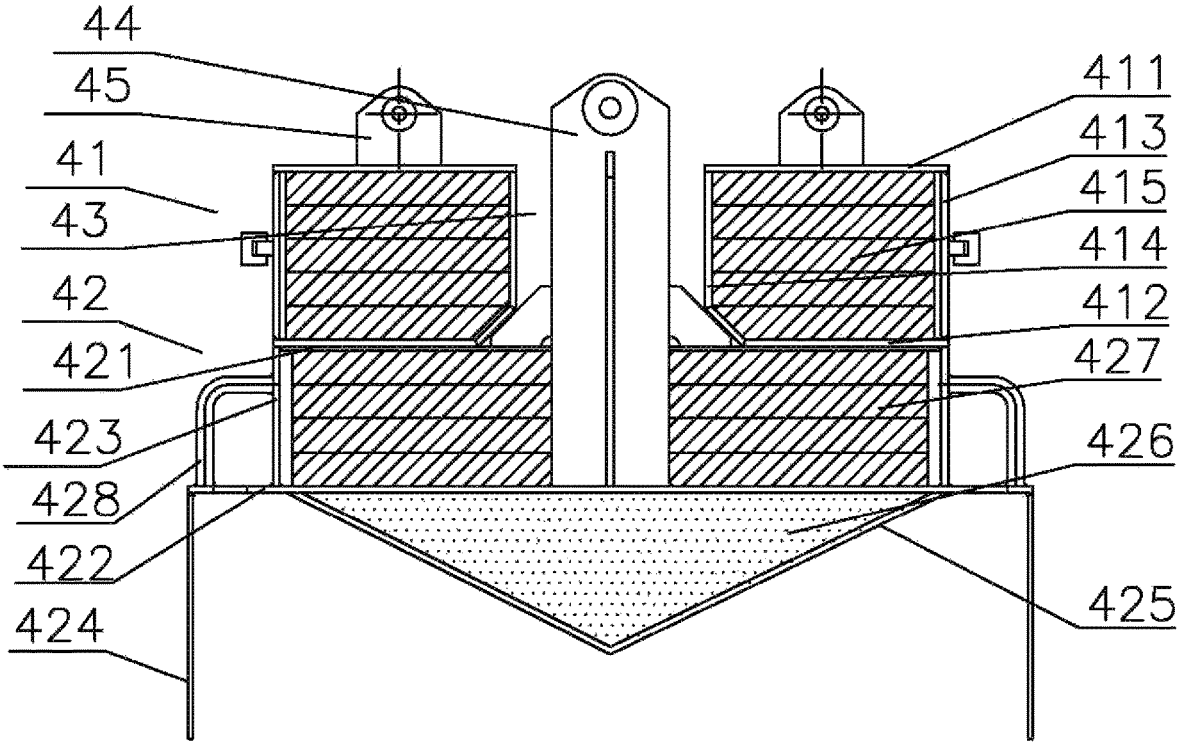
FIG. 2 is a structural diagram of a gravity type foundation base of the offshore tension anode system of the invention.

As shown in FIG. 1, FIG. 2, FIG. 3, FIG. 4 and FIG. 5, an offshore tension anode system comprises an offshore platform 1 formed by a steel frame (the dotted box in FIG. 1 schematically represents the offshore platform), a composite cable 2, a tension device 3 and a gravity type foundation base 4, wherein the offshore platform 1 includes an installation platform closest to the water surface and used for installation and a tension platform used for installing the tension device and arranged on the installation platform; the composite cable 2 is integrated with a plurality of sets of auxiliary anodes 21 and reference electrodes 22; the tension device 3 is installed on the tension platform; one end of the composite cable 2 is connected to the tension platform through the tension device 3 and the other end of the composite cable 2 sinks to the seabed through the gravity type foundation base 4; and the gravity type foundation base 4 includes an upper block 41 and a lower block 42 separated from the upper block 41, wherein a main lifting lug 44 is arranged on the lower block 42, a central hole 43 is formed in the center of the upper block 41, the upper block 41 is penetrated through by the main lifting lug 44 via the main central hole 43 and is arranged on the lower block 42, and auxiliary lifting lugs 45 are arranged on the upper surface of the upper block 41. Particularly, the upper block 41 includes an upper plate I 411, a lower plate I 412, an external annular side wall I 413, an internal annular side wall I 414, and a group of balancing weights I 415, wherein the upper plate I 411, the lower plate I 412, the external annular side wall I 413 and the internal annular side wall I 414 are welded to form an annular cavity, the balancing weights I 415 are arranged in the annular cavity and the auxiliary lifting lugs 45 are arranged on the upper plate I 411; the lower block 42 includes an upper plate II 421, a lower plate II 422, an external annular side wall II 423, an annular apron plate 424, a conical cavity plate 425, a filler 426, a group of balancing weights II 427 and the main lifting lug 44, wherein the upper plate II 421, the lower plate II 422 and the external annular side wall II 423 are welded to form an annular cavity, the balancing weight II 427 are arranged in the annular cavity, the conical cavity plate 425 is welded to the lower surface of the lower plate II 422 to form a conical cavity together with the lower plate II 422, the filler 426 is injected into the conical cavity and the annular apron plate 424 is welded to the edge of the lower plate II 422; and the lower block 42 is further provided with ROV operating handles 428.

The tension device 3 includes a tension rod device 31 and a locking device 32, wherein one end of the tension rod device 31 is connected to the composite cable 2 and the other end of the tension rod device 31 tensions the composite cable 2 by means of a tensioning jack on the tension rod device 31 and the locking device 32 is used to fixedly lock the composite cable 2 which has been tensioned by the tension rod device 31 on the tension platform.

An installation method of an offshore tension anode system comprises the following steps:

(1) lifting a composite cable and a gravity type foundation base to an installation platform: respectively lifting a cable reel spiraled with the composite cable which is integrated with auxiliary anodes and reference electrodes and the gravity type foundation base to the installation platform by a crane;

The lifting process of the composite cable typically comprises the following two steps: first, the cable reel spiraled with the composite cable is lifted from a ship to a temporary storage position of the installation platform, and a conventional lifting method is adopted in this process; second, the cable reel is lifted from the temporary storage position to a platform installation position (a temporary deck) through the cooperation of a platform crane, a pneumatic winch and a manual hoist hung on the deck and the platform installation position needs to be protected.

When the cable reel is lifted from the temporary storage position to the platform installation position, a rubber product (such as a tire) needs to be fixed to a supporting rod of a steel frame of an offshore platform or the external side of the ship for transporting the cable reel to prevent the cable reel from bumping against the offshore platform in the lifting process. When the platform crane, the pneumatic winch and the manual hoist hung on the deck work cooperatively for lifting, a structural joist steel of the installation platform may be directly used as a beam fixture of the manual hoist to serve as a turning point (such as a fixed pulley) and no welding is needed.

The lifting process of the gravity type foundation base is similar to that of the composite cable. Preferably, the gravity type foundation base is lifted as follows: all parts of the gravity type foundation base are respectively lifted to the installation platform by the lifting machines such as the platform crane, the pneumatic winch and the manual reel, wherein the parts of the gravity type foundation base include an upper plate I, a lower plate I, an external annular side wall I, an internal annular side wall I and a group of balancing weights I which constitute an upper block and an upper plate II, a lower plate II, an external annular side wall II, an annular apron plate, a conical cavity plate, a filler, a balancing block II and a main lifting lug which constitute a lower block. By respectively lifting these parts to the installation platform, the cranes with a small lifting capacity can fulfill the lifting of a large object.

In this step, the parts of the gravity type foundation base are welded and assembled on the installation platform. Particularly, the lower plate I, the external annular side wall I, and the internal annular side wall I of the upper block are welded to form the annular cavity I having an end with an opening, then the balancing weights I are arranged in the annular cavity I and afterwards, the upper plate I is welded to the upper block to form the whole upper block; and the lower plate II, the external annular side wall II, the annular apron plate, the conical cavity plate, ROV operating handles and the main lifting lug of the lower block are sequentially welded according to a drawing to form the lower block having an upper end with an opening, the lower plate II and the external annular side wall II of the lower block form the cavity II, the conical cavity plate and the lower plate II are welded to form the conical cavity, the filler is fully injected into the conical cavity via a through hole formed in the lower plate II in the cavity II, then the balancing weights II are arranged in the cavity II, and afterwards, the upper plate II is fixedly welded to form the whole lower block.

Figure 3:
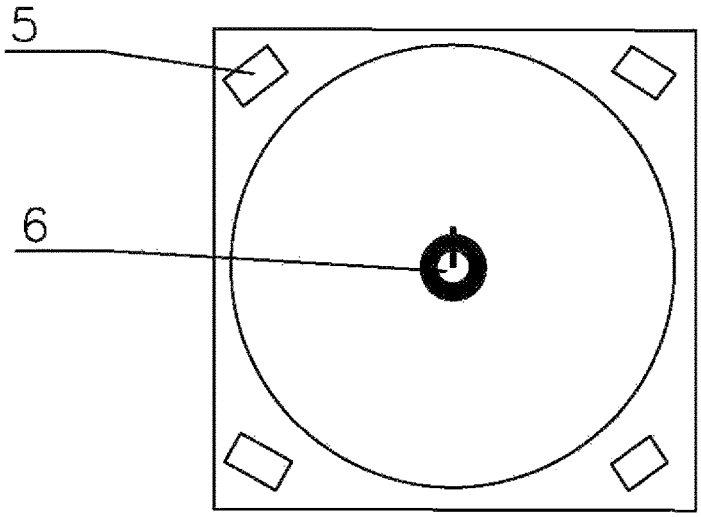
FIG. 3 is a schematic diagram of a gravity type foundation base intended position area.

(2) The gravity type foundation base is installed on the seabed: a wire rope of the winch is connected to the main lifting lug of the lower block and sinks the lower block to a gravity type foundation base intended position area, as shown in FIG. 3, defined by sandbags 5 on the seafloor, and then the wire rope is retrieved; and the wire rope of the winch is connected to auxiliary lifting lugs of the upper block and sinks the upper block to make the main lifting lug of the lower block to enter a main central hole of the upper block to complete the assembly of the upper block and the lower block, and then the wire rope is retrieved.

In this step, an ROV performs positioning first with the assistance of a sonar device to lay the sandbags 5 around a floating marker ball 6 to define the gravity type foundation base intended position area, and after the intended position area is defined, the floating marker ball 6 encircled by the sandbags is moved out of the intended position area to keep the bottom surface of the intended position area flat.

Figure 4:
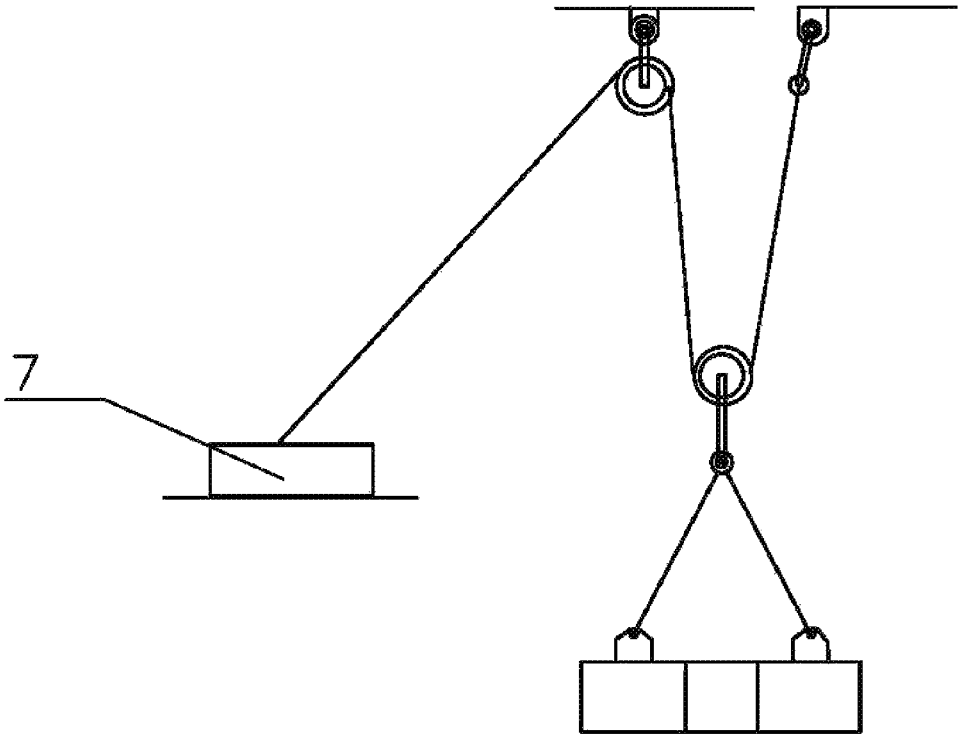
FIG. 4 is a lifting diagram of an upper block.
Figure 5:
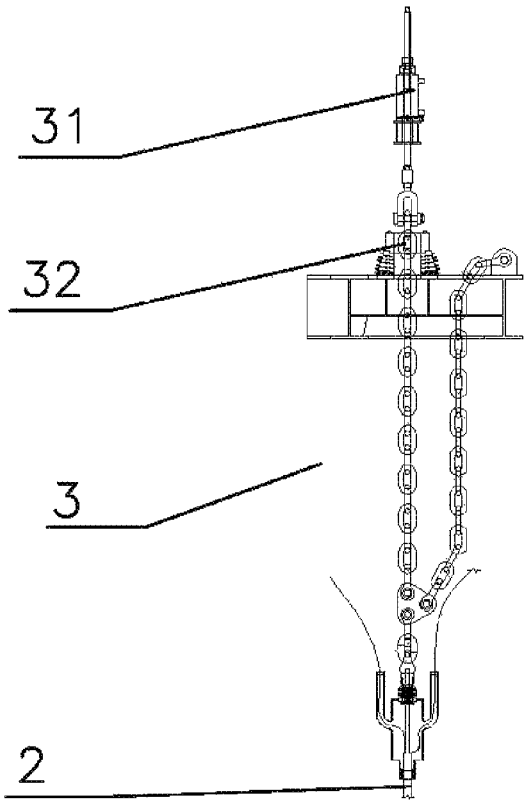
FIG. 5 is a schematic diagram of a tension device for tensioning and fixing a composite cable.

Then, as shown in FIG. 4, the wire rope of the winch 7 is connected to the main lifting lug of the lower block and sinks the lower block through the winch. In order to ensure the reliability and accuracy of the sinking process of the lower block and an underwater winding-releasing device for the wire rope of the winch, the lower block can be guided and accessorily positioned by the ROV when lowered; and the ROV can control the ROV operating handles on the gravity type foundation base to guide and accessorily position the gravity type foundation base to make sure that the positioning accuracy not greater than 10 cm. After the lower block reaches the seafloor, the wire rope of the winch is released and is retrieved to the water surface, and in this way, the sinking of the lower block is completed.

Afterwards, the wire rope of the winch is connected to the auxiliary lifting lugs of the upper block and sinks the upper block under the effect of the winch, and the ROV guides and accessorily positions the upper block at the same time; when the upper block approaches the lower block, the position of the upper block is adjusted to make the main central hole of the upper block correspond to the main lifting lug of the lower block and is then slowly adjusted to make the main lifting lug of the lower block to enter the main central hole, so that the underwater assembly of the upper block and the lower block is completed; and then the wire rope of the winch is released and is retrieved to the water surface.

As shown in FIG. 4, when the gravity type foundation base is sunk and assembled by the winch, the fixed pulley needs to be used to change the force application direction of the wire rope of the winch, and the gravity type foundation base is connected to the wire rope of the winch through a movable pulley to operate the winch and to reduce the tensile force of the wire rope of the winch. Wherein, the movable pulley may be directly fixed to an H-shaped steel frame next to a tension platform on the installation platform, the winch is arranged on the installation platform, and the wire rope of the winch winds across the fixed pulley to be connected to the gravity type foundation base to make sure that the gravity type foundation base is located over the gravity type foundation base intended position area on the seafloor.

(3) The composite cable is installed: the end of the composite cable, spiraled on the cable reel, is connected to a heavy ball, the composite cable is connected to the wire rope of the winch, and the cable reel is started to rotate to release the composite cable, wherein with the descending of the heavy ball and the dragging of the wire rope of the winch, the composite cable is sunk close to the gravity type foundation base; and the composite cable is connected to the gravity type foundation base by the ROV.

In this step, one end of the composite cable lifted to the cable reel on the installation platform is connected to the heavy ball, the composite cable is connected to the wire rope of the winch, and the cable reel is started to rotate to release the composite cable, wherein with the descending of the heavy ball, one end of the composite cable is dragged by the wire rope of the winch to be lowered close to the gravity type foundation base; and the composite cable can also be accessorily positioned and adjusted by the ROV when lowered and is finally lowered close to the gravity type foundation base, and then the composite cable is separated from the heavy ball and the wire rope of the winch, and is connected to the gravity type foundation base by the ROV.

(4) The composite cable is tensioned, adjusted, and fixedly locked: the other end of the composite cable is connected to a tension rod device of a tension device on the tension platform; the composite cable is tensioned by the tension rod device to adjust tension of the composite cable in water; and the composite cable with the tension having been adjusted is fixedly locked on the tension platform by a locking device of the tension device.

The composite cable needs to be tensioned to be in a tightened state after being lowered to the seafloor and being connected to the gravity type foundation base, and the composite cable is tensioned by the tension device installed on the tension platform which is arranged on the installation platform; the tension device includes the tension rod device and the locking device, wherein one end of the tension rod device is connected to the end, away from the gravity type foundation base, of the composite cable, and the other end of the tension rod device tensions the composite cable by means of a tensioning jack to adjust the tension of the composite cable; and after the tension of the composite cable has been adjusted by the tension rod device, the composite cable is fixedly locked on the tension platform by the locking device to complete the tensioning and fixed locking of the composite cable.

In order to ensure that the composite cable is tensioned all the time within the whole life cycle, the tension device may be stored in a platform equipment room. The tension device can be installed in position to tension and adjust the composite cable at any time when the composite cable needs to be tensioned.

The gravity type foundation base and the composite cable may be monitored and positioned in real time by a positioning probe when lowered and installed underwater to complete the installation of the whole structure. By adoption of the positioning probe, the structure is simpler, and the cost is reduced.

In summary, the above embodiments are only preferred ones of the invention, and are not intended to limit the protection scope of the invention. Equivalent substitutions or alterations made by those skilled in the art on the basis of the technical solutions and conception of the invention within the technical scope of the invention should also fall within the protection scope of the invention.

The invention claimed is:

1. An offshore tension anode system, comprising a tension platform, a tension device, a composite cable, and a gravity type foundation base, wherein:

the composite cable is integrated with auxiliary anodes and reference electrodes, the tension device is installed on the tension platform, and a first end of the composite cable is connected to the tension platform through the tension device and a second end of the composite cable connects to the gravity type foundation base; and the gravity type foundation base comprises an upper block and a lower block, wherein the upper block and the lower block are separated from each other, a main lifting lug is arranged on the lower block, a main central hole is arranged in a center of the upper block, the upper block is placed above the lower block and the main lifting lug extends through the upper block via the main central hole, and a plurality of auxiliary lifting lugs are arranged on an upper surface of the upper block.

2. The offshore tension anode system according to claim 1, wherein the tension device comprises a tension rod device and a locking device, wherein the tension rod device comprises a tensioning jack and has a first end connected to the composite cable and the second end used for tensioning the composite cable by means of the tensioning jack, and the locking device fixedly locks the composite cable that has been tensioned by the tension rod device on the tension platform.

3. The offshore tension anode system according to claim 1, wherein the upper block comprises an upper plate I, a lower plate I, an external annular side wall I, an internal annular side wall I, and a plurality of balancing weights I, wherein the upper plate I, the lower plate I, the external annular side wall I, and the internal annular side wall I are welded together to form an annular cavity I, and the plurality of balancing weights I are arranged in the annular cavity I, and the plurality of auxiliary lifting lug are arranged on the upper plate I; and the lower block includes an upper plate II, a lower plate II, an external annular side wall II, an annular apron plate, a conical cavity plate, a filler, a plurality of balancing weights II, and the main lifting lug, wherein the upper plate II, the lower plate II, and the external annular side wall II are welded together to form a cavity II, the plurality of balancing weights II are arranged in the cavity II, the conical cavity plate is welded to a lower surface of the lower plate II to form a conical cavity together with the lower plate II, the filler is disposed in the conical cavity, and the annular apron plate is welded to an edge of the lower plate II; and the lower block is further provided with an remote operated vehicle (ROV) operating handle.

4. An installation method of an offshore tension anode system, comprising:

(1) lifting a composite cable and a gravity type foundation base to an installation platform by respectively lifting a cable reel spiraled with the composite cable integrated with auxiliary anodes and reference electrodes and the gravity type foundation base to the installation platform;

(2) installing the gravity type foundation base on a seabed by connecting a wire rope of a winch to a main lifting lug of a lower block, sinking the lower block to an intended position area defined by sandbags on the seabed, and then retrieving the wire rope; and connecting the wire rope to a plurality of auxiliary lifting lugs of an upper block, sinking the upper block to let the main lifting lug of the lower block extend through a central hole of the upper block to complete assembling of the upper block and the lower block, and then retrieving the wire rope;

(3) installing the composite cable by connecting a first end of the composite cable spiraled on the cable reel to a heavy ball and the wire rope of the winch, and starting the cable reel to rotate to release the composite cable, sinking the composite cable in a proximity of the gravity type foundation base by descending the heavy ball and dragging the wire rope of the winch; and connecting the composite cable to the gravity type foundation base by an ROV; and (4) tension adjustment and lock fixation of composite cable by connecting a second end of the composite cable to a tension rod device of a tension device on a tension platform; tensioning the composite cable by the tension rod device to adjust tension of the composite cable in water; and fixedly locking the composite cable with adjusted tension on the tension platform by a locking device of the tension device.

5. The installation method of the offshore tension anode system according to claim 4, wherein in Step (1), lifting the gravity type foundation base to the installation platform comprises: lifting an upper plate I, a lower plate I, an external annular side wall I, an internal annular side wall I, and a plurality of balancing weights I to the installation platform, welding and assembling to form the upper block; and lifting an upper plate II, a lower plate II, an external annular side wall II, an annular apron plate, a conical cavity plate, a filler, a plurality of balancing weight II, an ROV operating handle and the main lifting lug to the installation platform, welding and assembling to form the lower block.

6. The installation method of the offshore tension anode system according to claim 4, where in Step (2), the gravity type foundation base is positioned by a sonar system when sinking to the seabed and an assembly process of the upper block and the lower block is detected by the ROV.

7. The installation method of the offshore tension anode system according to claim 4, where in Step (3), an installation process of the composite cable comprises tracking, detecting, and positioning the composite cable in real time by the ROV when sinking in the proximity of the gravity type foundation base; and separating the composite cable from the heavy ball; and connecting the composite cable to the gravity type foundation base by the ROV.

* * * * *